US007777435B2

(12) United States Patent
Aguilar et al.

(10) Patent No.: US 7,777,435 B2
(45) Date of Patent: Aug. 17, 2010

(54) ADJUSTABLE FREQUENCY PUMP CONTROL SYSTEM

(76) Inventors: Ray A. Aguilar, 1251-0 S. Beach Blvd., LaHabra, CA (US) 90631; Robert M. Castle, 1251-0 S. Beach Blvd., LaHabra, CA (US) 90631

( * ) Notice: Subject to any disclaimer, the term of this patent is extended or adjusted under 35 U.S.C. 154(b) by 765 days.

(21) Appl. No.: 11/701,269

(22) Filed: Feb. 1, 2007

(65) Prior Publication Data

US 2008/0187443 A1 Aug. 7, 2008

Related U.S. Application Data

(60) Provisional application No. 60/763,993, filed on Feb. 2, 2006.

(51) Int. Cl.
*F04B 49/02* (2006.01)
*F04B 49/06* (2006.01)

(52) U.S. Cl. ..... 318/268; 417/44.1; 417/44.2

(58) Field of Classification Search ..... 318/268; 417/43, 44.1, 45, 44.2, 22, 44.11
See application file for complete search history.

(56) References Cited

U.S. PATENT DOCUMENTS 3,365,064 A 1/1968 Horan
3,963,375 A 6/1976 Curtis
4,482,461 A 11/1984 Hindman et al.
4,505,643 A 3/1985 Millis et al.
4,676,914 A 6/1987 Mills et al.
5,584,992 A 12/1996 Sugimoto
5,730,861 A 3/1998 Sterghos et al.
5,895,565 A 4/1999 Steininger et al.
7,156,983 B2 1/2007 Burrey
2003/0196942 A1* 10/2003 Jones ..... 210/169
2007/0154320 A1* 7/2007 Stiles et al. ..... 417/43
2007/0163929 A1* 7/2007 Stiles et al. ..... 210/97
2008/0003114 A1* 1/2008 Levin et al. ..... 417/306

* cited by examiner

*Primary Examiner*—Bentsu Ro

(57) ABSTRACT

An adjustable frequency pump control system (10) that is primarily designed for use in commercial pool filtration systems. The system (10) automatically selects one of three operating speeds that control the speed of a motor that operates a circulation pump (62). The system (10) includes a programmed logic control (PLC) (42) that is activated upon the application of select mode signal (31), a mode timing signal (35), a line pressure signal (37), a circulation pump-run signal (39) and a backwash signal (41). The output of the PLC (42) is a frequency set signal (17) that is applied to an adjustable frequency drive (AFD) (18). From the output of the AFD (18) a motor speed control signal is produced that is applied to the motor that operates the circulation pump (62). The speed of the circulation pump (12) is governed by the frequency of the motor speed control signal, wherein the frequency is determined by the motor speed that is applicable to a particular design point of the pump's filtration cycle.

44 Claims, 11 Drawing Sheets

ADJUSTABLE FREQUENCY PUMP CONTROL SYSTEM

The application claims priority of Provisional Patent Application No. 60/763,993 filed Feb. 2, 2006.

TECHNICAL FIELD

The invention generally pertains to commercial pool filtration systems that use a media (sand and/or gravel) filter. The invention particularly pertains to an adjustable frequency pump control system that automatically controls the speed of a water circulation pump to adjust for various water pumping loads.

BACKGROUND ART

Commercial pool filtration systems must be able to control a wide range of operating conditions or filtration cycles. Each filtration cycle is subject to a large number of operational changes dependent upon the pump used, filter type, flow rate, and environmental conditions. In applications such as commercial pool filtration systems there are requirements mandated by local building codes for minimum pump flow rates in order to provide adequate filtration.

The pump's primary design point is selected to operate against the most demanding condition in the filtration cycle, that is the dirtiest filtration point which occurs just prior to a pool backwash. The water circulation pump is selected to operate at the design point as efficiently as possible. Unfortunately, when pool filters are clean the pump operates against a total head of 10 PSI to 15 PSI which is less than the primary design point. This condition results in the pump operating for extended periods of time at an inefficient position on its performance curve and may result in damaging cavitation. Cavitation is the sudden formation and collapse of low pressure bubbles in liquid by means of mechanical forces. Cavitation not only causes the pump to under perform but is also very damaging to the pump's impeller and other internal components which can shorten the pump's useful life.

The instant invention maintains an optimum water flow rate by adjusting the speed of the pump to match the loads that vary throughout the filter cycle. In doing so it keeps the overall pump performance within the most efficient area of operation which saves energy, and results in less wear and tear, increases the reliability and extends the useful life of the pump. The invention also has other special energy saving features of operation that allow the pump to be slowed or stopped during pool-closure hours.

A search of the prior art did not disclose any literature or patents that read directly on the claims of the instant invention. However, the following U.S. patents are considered related:

| U.S. PAT. NO. | INVENTOR | ISSUED |
|---|---|---|
| 7,156,983 | Burrey | 2 Jan. 2007 |
| 5,730,861 | Sterghos et al | 24 Mar. 1998 |
| 4,676,914 | Mills et al | 30 Jun. 1987 |
| 4,505,643 | Millis et al | 19 Mar. 1985 |

The U.S. Pat. No. 7,156,983 patent discloses a swimming pool backwash control system that includes a timer and a valve combination that controls normal re-circulating and backwash flow through a swimming pool filter. The timer is in series with an electric power circuit that activates the pool pump when the valve is moved to the backwash flow position. The timer also maintains the electric power to the pump for a user-specified or a pre-set period. At the end of the period the timer causes the circuit to open, thereby disabling the pump. Power can be restored to the pump by returning the valve to its normal re-circulating flow position.

The U.S. Pat. No. 5,730,861 patent discloses a swimming pool control system that automatically controls the daily maintenance functions of a swimming pool. The control system monitors system conditions, makes adjustments for abnormal conditions, and provides remote feedback of system problems during its daily cycle.

The U.S. Pat. No. 4,676,914 patent discloses a pump that pumps water from a swimming pool to a forward/reverse direction control valve. The control valve has a forward flow state in which it channels water into an inlet of a filter and from a filter outlet back to the swimming pool.

The U.S. Pat. No. 4,505,643 patent discloses a circulating pump that pumps water between a swimming pool and a filter or other circulated fluid receiving apparatus. A control circuit operates the circulating pump and includes a first timer and a cycle switch which is cyclically closed to produce a pump signal for a first duration that starts a second timer. The second timer holds a time controlled switch conductive for a pre-selected time period. When the pressure monitored by a pressure sensor exceeds a pre-selected pressure, a low pressure switch closes conducting the pump signal around the bypass and time controlled switches.

For background purposes and as indicative of the art to which the invention relates, reference may be made to the following remaining patents found in the search:

| U.S. PAT. NO. | INVENTOR | ISSUED |
|---|---|---|
| 5,895,565 | Steininger, et al | 20 Apr. 1999 |
| 5,584,992 | Sugimoto | 17 Dec. 1996 |
| 4,482,461 | Hindman, et al | 13 Nov. 1984 |
| 3,963,375 | Curtis | 15 Jun. 1976 |
| 3,365,064 | Horan | 23 Jan. 1968 |

DISCLOSURE OF THE INVENTION

The adjustable frequency pump control system (AFPCS) disclosed herein is designed to automatically control the speed of a pool's circulation pump. The speed of the circulation pump is determined by a frequency adjusted, motor speed control signal. The speed of the circulation pump is selected to correspond to a particular design point of the pump's filtration cycle.

In its basic design configuration the AFPCS functions in combination with a plurality of system-external elements. These elements include a power input, a circulation pump, and a chemical or filter control unit that produces a circulation pump-run signal and a backwash signal.

The AFPCS consists of:

a) An enclosure that is dimensioned to enclose all the elements that comprise the system, and includes a means for interfacing with the power input, the circulation pump and the chemical or filter control unit.

b) An adjustable frequency drive (AFD) that is programmed during the start-up of said AFPCS, with data that includes set points and switching sequences that meet a customer's requirements. The AFD has an input that is connected to the power input and an output consisting of the frequency-controlled, motor speed control signal.

c) A power supply having an input connected to the power input and an output consisting of a first voltage and a second voltage, d) A system mode selector switch having an input that is connected to the first voltage and an output consisting of a selected mode signal that controls the following modes:

a bypass mode, a normal filtration mode, a manual backwash mode, a normal filtration plus, an automatic mode, and an automatic plus mode, e) A time clock having an input that is connected to the first voltage, and an output consisting of a mode timing signal, f) A pressure transducer that when enabled by the application of the second voltage produces a line pressure signal, g) A program logic control (PLC) having a plurality inputs and an output, wherein the plurality of inputs are comprised of:

the selected mode signal that is applied from the system mode selector switch, a timing signal that is applied from the time clock, the circulation pump-run signal applied from the chemical or filter control unit, the backwash signal applied form the automatic chemical and filter control, and the line pressure signal applied from the pressure transducer.

The output of the PLC is the frequency-set signal that is applied to the AFC that in combination with the software produces the frequency controlled motor speed signal that is ultimately utilized to control the speed of the circulation pump.

In view of the above disclosure, the primary object of the invention is to produce an adjustable frequency pump control system (AFPCS) that automatically maintains an optimum flow rate throughout all aspects of a pool's filtration cycle.

In addition to the primary object of the invention it is also an object of the invention to produce an AFPCS that:

is designed to be enclosed within a single, vented and fan-cooled enclosure, provides an easily accessible programming keypad, does not require a back-up battery, can include a customer-selected password to access the system, is easily installed, can be designed to operate with a customer-selected input power, can be designed to be used in other applications where a variable liquid flow rate is utilized, is reliable and easily maintained, and is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1A:
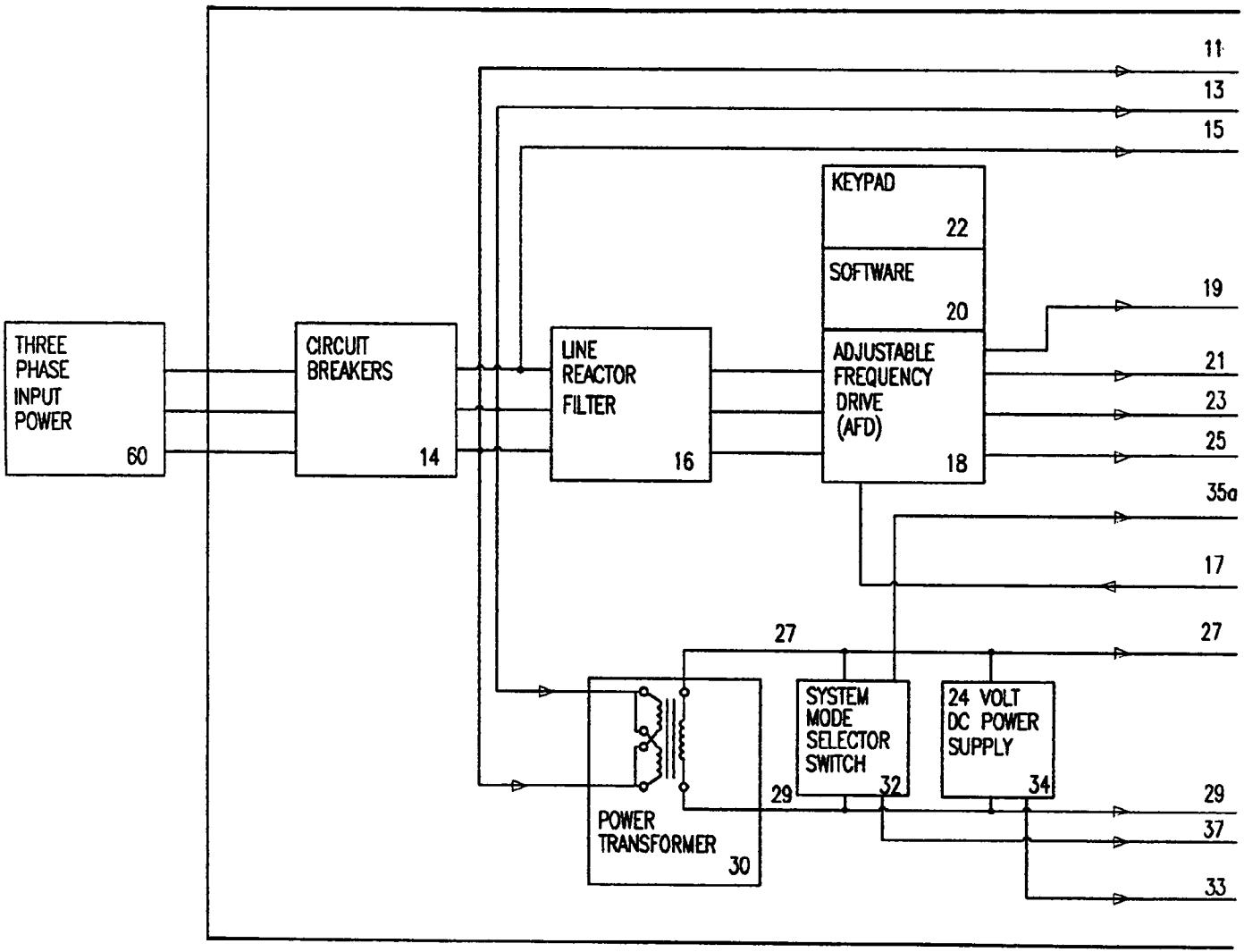
FIGS. 1A and 1B are sequential block diagrams of the adjustable frequency pump control system (AFPCS), also referred to as a SMART PUMP CONTROL SYSTEM™ (SPCS).

The best mode for carrying out the invention is presented in terms of a preferred embodiment for an adjustable frequency pump control system 10, (hereinafter "AFPCS 10"). The AFPCS 10 is designed to optimize the performance of a pool's water circulation pump at all the design points of the pump's filtration cycle.

The preferred embodiment of the AFPCS 10, which is also referred to as a SMART PUMP CONTROL SYSTEM (SPCS)™, is shown in FIGS. 1-11, and is comprised of the following major elements: an enclosure 12, a set of three circuit breakers 14, a set of three line reactor filters 16, an adjustable frequency drive (AFD) 18 that is operated by a software program 20 and a keypad 22, an AFD motor contactor 24, a bypass contactor 26, a motor thermal overload 28, a power transformer 30, a system mode selector switch 32, a d-c power supply 34, a pressure transducer 36, a time clock 38, a fan 40, and a programmed logic control (PLC) 42 that is preferably programmed by the keypad 22. The AFPCS 10 operates in combination with the following system-external elements: a three-phase a-c power input 60, a circulation pump 62, and a chemical or filter control unit 64 that produces a circulation pump-run signal 39 and a backwash signal 41.

Figure 3:
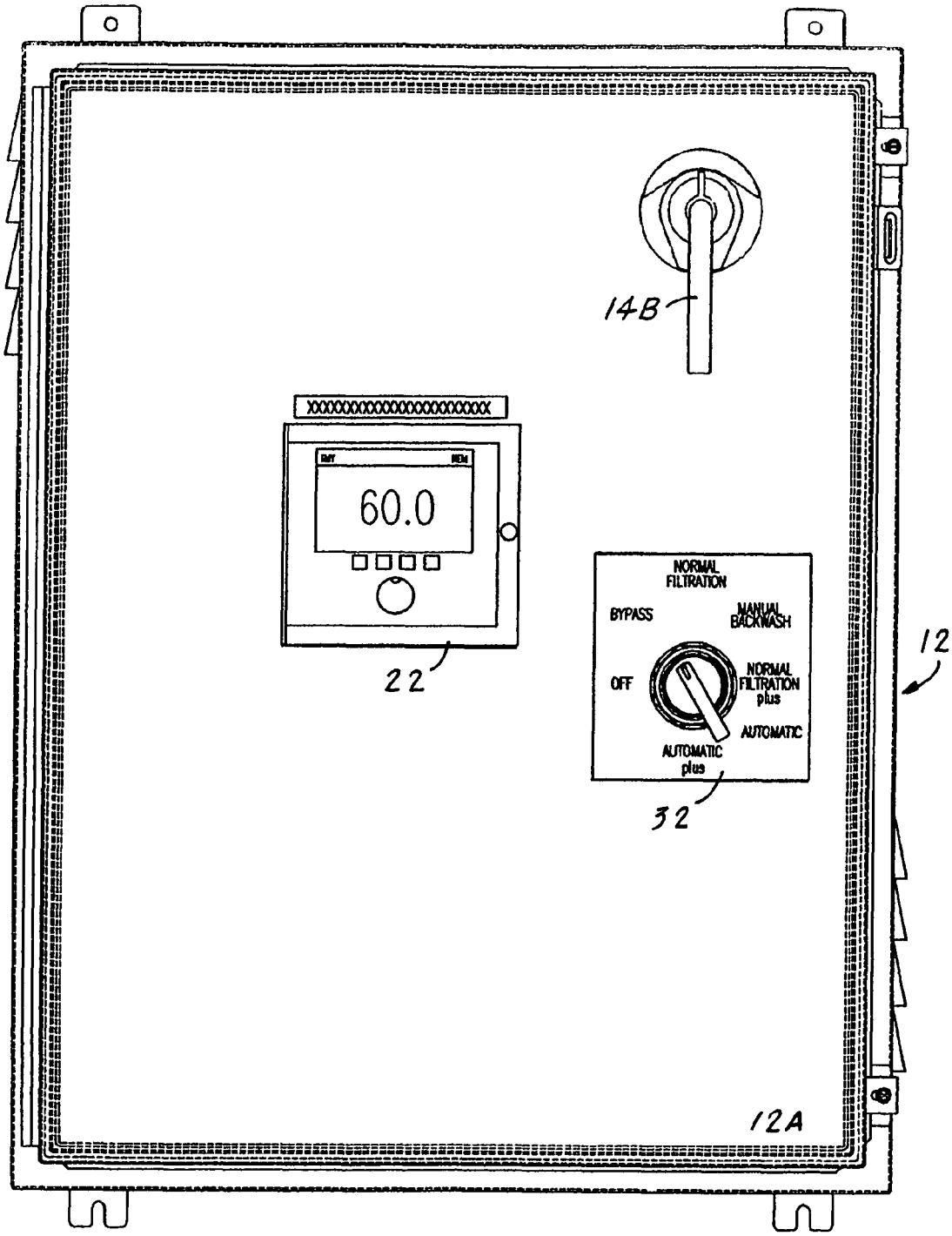
FIG. 3 is a front elevational view of the front door layout of the AFPCS wall-mounted enclosure.
Figure 4:
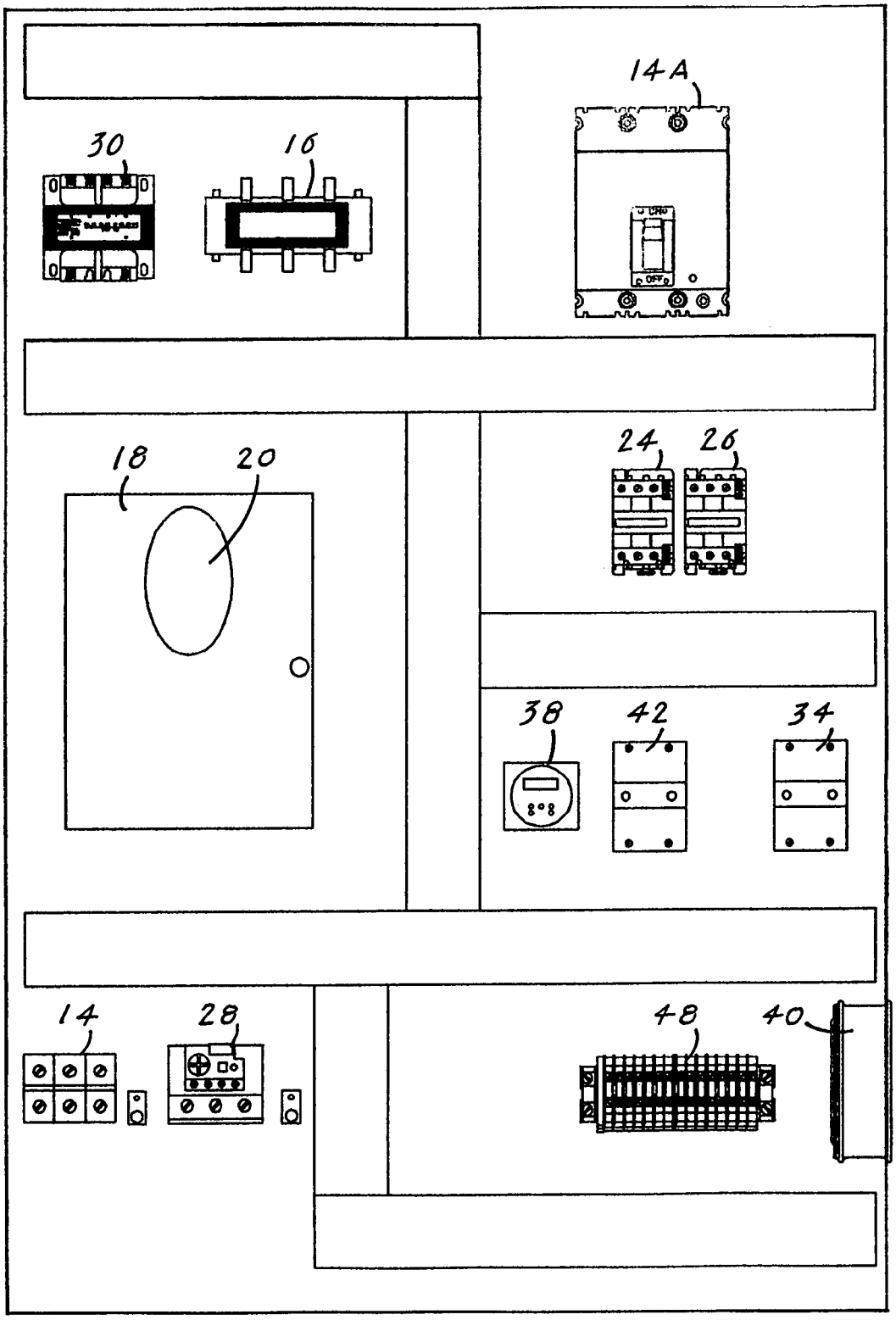
FIG. 4 is a front elevational view of the enclosure's inner panel.

The enclosure 12, as shown in FIGS. 3 and 4, is dimensioned to enclose all the elements that comprise the AFPCS 10. Preferably, the enclosure 12 is comprised of a National Electrical Manufacturers Association (NEMA) wall-mounted enclosure having a front door 12A that includes along the entire door perimeter a neoprene gasket. The gasket is designed to prevent inclement weather and/or corrosive elements from entering the enclosure 12. The enclosure is also powder coated to provide further protection from corrosive environments.

When the enclosure's front door 12A is opened, an inner panel 12B is exposed, as shown in FIG. 4. The front door 12A allows access to a circuit breaker handle 14B, the keypad 22 and the system mode selector switch 32. The inner panel 12B allows access to the circuit breakers 14, a main circuit breaker 14A, the line reactor filter 16, the AFD 18, the software 20, the AFD motor contactor 24, the bypass contactor 26, the thermal motor overload 28, the d-c power supply 34, the time clock 38, the fan 40, the PLC 42 and a terminal block 48.

The externally applied power input 60, as shown in FIG. 1A, is comprised of a three-phase a-c power input that is applied through lines 11, 13, and 15. The power can be selected from either 200 to 230 volts a-c or 380 to 420 volts a-c. Either input voltage operates at a frequency between 50 to 60 Hz. The three-phase lead lines 11, 13, 15 are applied through the three circuit breakers 14. The three power leads 11, 13, 15 are applied to the bypass contactors 26 (described infra) and to the three line reactor filters 16 which are designed to filter power line disturbances, harmonics, surge currents and power line spikes to produce filtered a-c voltages.

The AFD 18, as also shown in FIG. 1A, is applied the filtered, a-c voltage from the line reactor filters 16 and a frequency-set signal 17 that is applied from the PLC 42 (described infra). The AFD 18 operates in combination with the software 20 and a keypad 22.

The software 20 controls the settings that are retained in the memory of the AFD 18. These settings include but are not limited to motor horsepower, voltage, motor RPM, current draw, the circulation pump set point (CPSP), the backwash speed (BWSPD) and the plus set point (PSP).

The keypad 22 displays the speed of the circulation pump speed in revolutions per minute (RPM), pump frequency, accumulated power usage, current power usage, pool's return line pressure, accumulated run time and various selectable fault messages.

The primary function of the AFD 18 is to control the input frequency that is ultimately applied to the circulation pump 62 which, in turn, controls the speed of the circulation pump 62. Presently, three frequency-set operating speeds are available:

(1) Normal filtration speed, (2) Backwash speed, and (3) Plus speed.

The outputs of the AFD 18 consist of a motor contactor close signal 19 and a set of three motor speed control signals 21, 23 and 25.

The AFD motor contactor 24 that when closed by the application of the motor contactor close signal 19 passes the motor control signals 21, 23 and 25 onto the motor thermal overload 28. At the output of the AFD motor contactor 24 is a bypass contactor 26 that is used to bypass the AFD 18 which occurs when switched into the bypass mode by user via mode selector switch. The outputs from either the AFD motor contactor 24 or the bypass contactor 26 are applied to the motor thermal overload circuit 28 that protects the motor from thermal overload.

The thermal overload circuit 28 produces a set of motor speed control signals 21, 23, 25 that in combination with the AFD 18 and the PLC 42 operates the circulation pump 62 at a selected speed.

The input power leads 11 and 13 applied from the output of the circuit breakers 14 and applied to the primary winding 30A of the power transformer 30. The secondary winding 30B of the power transformer 30 is a stepped-down voltage that ranges from 110 to 120 volts a-c. The stepped-down voltage is applied across lead lines 27 and 29 to the inputs of the system mode selector switch 32, the d-c power supply 34, the time clock 38, the fan 40 and the PLC 42.

Figure 5:
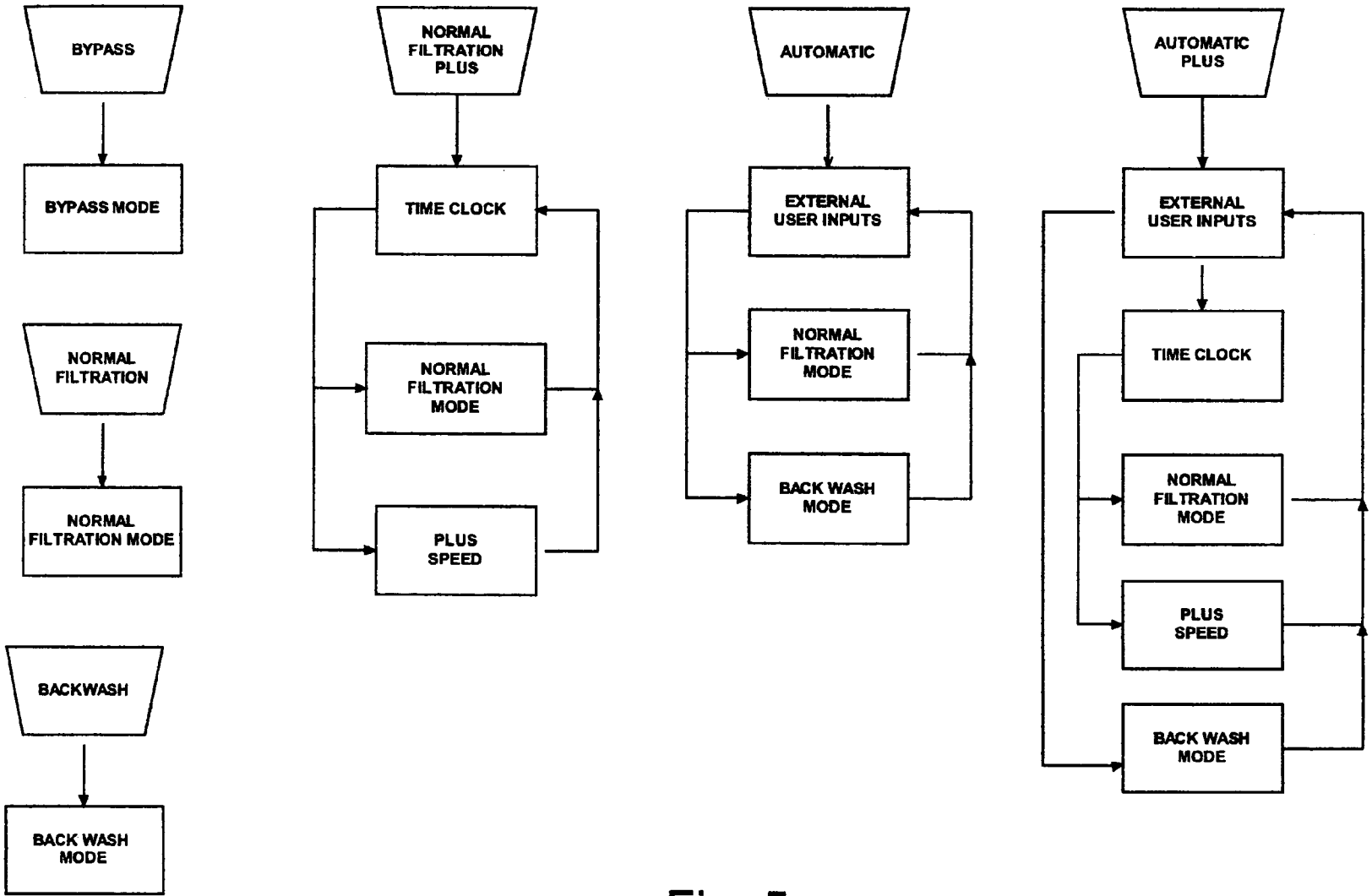
FIG. 5 is a flow diagram of the AFPCS selector switch showing the switches' six positions as they pertain to the software program.

The system mode selector switch 32 is mounted on the enclosure's front door 12A and allows a user of the AFPCS 10 to select any of six system operating modes or to turn off the AFPCS 10. The six operating modes are shown in FIG. 5 and are listed below:

(1) bypass, (2) normal filtration, (3) manual backwash, (4) normal filtration plus, (5) automatic, and (6) automatic plus.

The output of the d-c power supply 34 is a regulated 24-volts d-c that is applied through a lead line 33. The output is applied to and powers the pressure transducer 36 as described infra.

The time clock 38 produces an output consisting of a mode timing signal 35.

The fan 40, which can consist of a single fan 40 or a plurality of fans 40 can include a filter 40A. The fan(s) 40 are optimally placed on the enclosure 12 to maintain the enclosure elements cool and to further protect the AFPCS 10 elements from a corrosive environment.

The PLC 42 is designed to operate in combination with the AFD 18 to control the speed of the motor that operates the circulation pump 62. The six inputs applied to the PLC are comprised of:

(1) a PLC enabling input that is applied through the lead lines 27 and 29 from the secondary winding 30B of the power transformer 30, (2) a selected mode signal 31 applied from the system mode selector switch 32, (3) a mode timing signal 35 that is applied from the time clock 38, (4) a line pressure signal 37 that is applied from the pressure transducer 36, (5) a circulation pump-run signal 39 that is applied from the chemical or filter control unit 64, and (6) a backwash signal 41 that is also applied from the chemical or filter control unit 64.

Figure 1B:
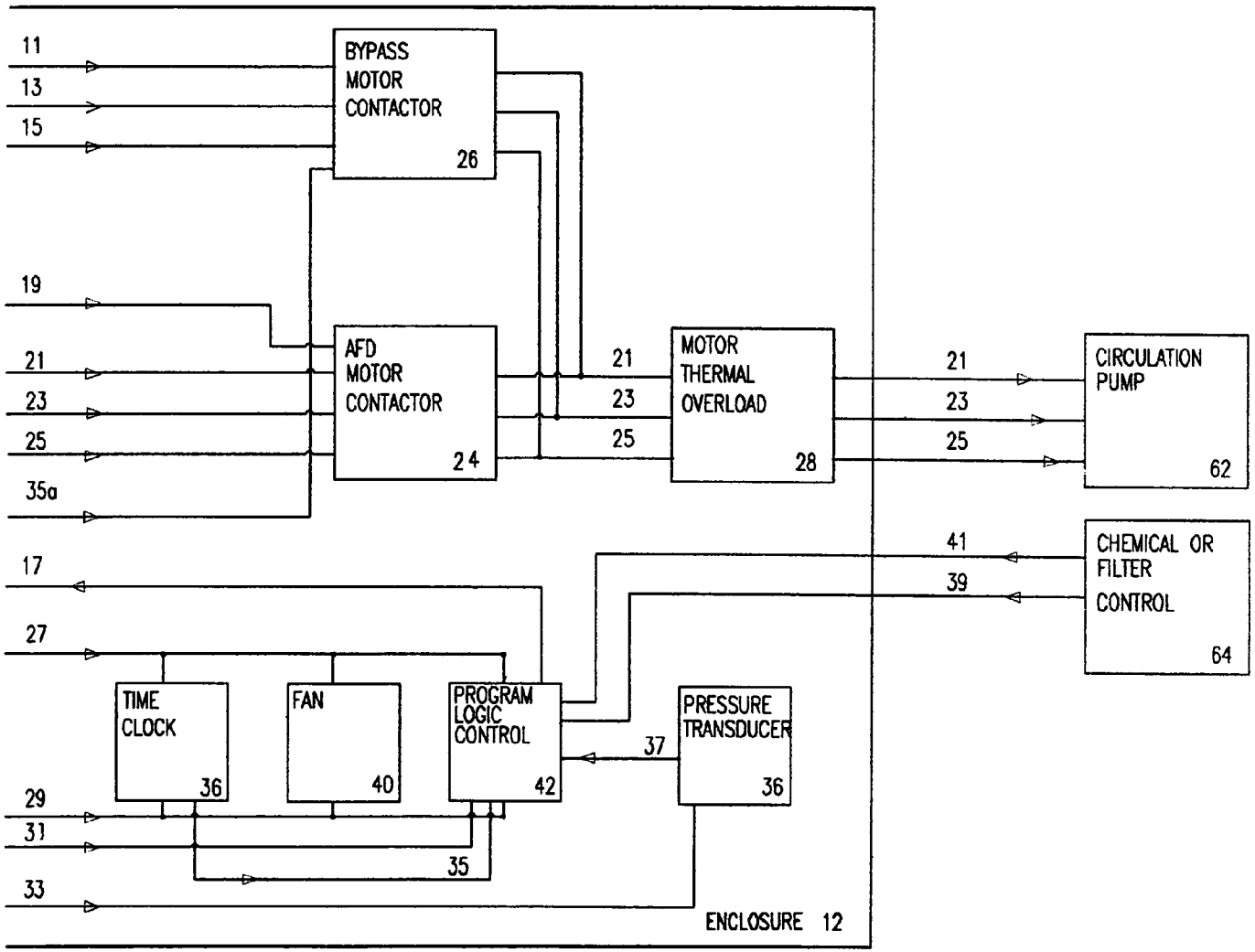
Figure 2:
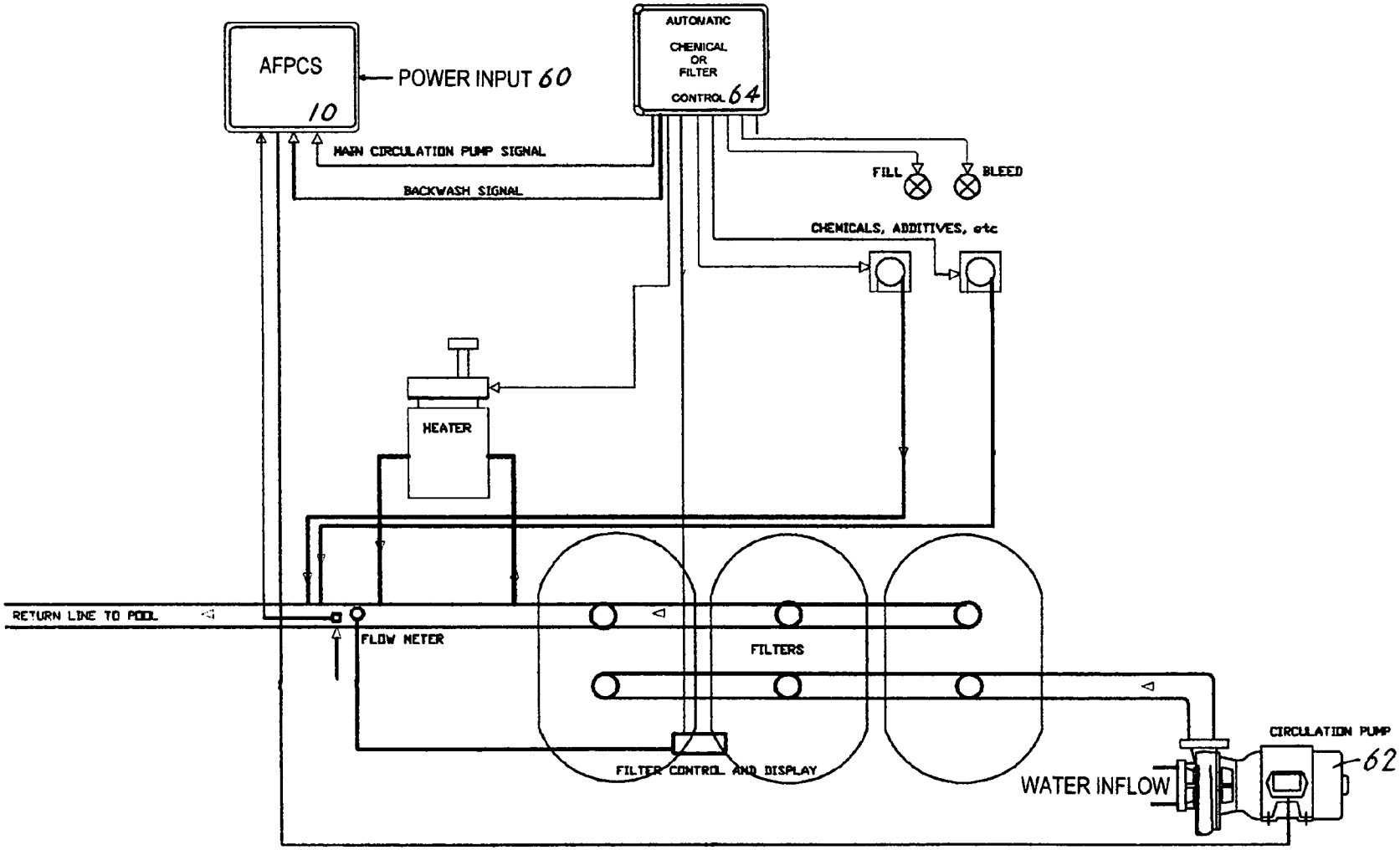
FIG. 2 is a block diagram showing the AFPCS installed in a typical prior art commercial pool filtration system.

The output of the PLC is the frequency-set signal 17 that is ultimately utilized, as shown in FIGS. 1A and 1B, to control the speed of the circulation pump 62.

The pressure transducer 36 when enabled by the 24-volts d-c signal 33 applied from the d-c power supply 34, produces the line pressure signal 37 that is one of the signals that controls the operation of the PLC 42. The pressure transducer 36, which can be operated at a PSI ranging from 0 to 50, is provided with a 50-froot shielded connection cable to allow the pressure transducer 36 to be easily installed and serviced if necessary.

In FIG. 1B, the pressure transducer 36 is shown within the confines of the enclosure 12. However in practice, the pressure transducer 36 is located external to the enclosure 12.

Operation

Normal Filtration Speed: during the initial start-up of the AFPCS 10, the speed of the circulation pump 62 is adjusted until the desired flow rate is achieved. The flow rate is indicated by a flow meter located in a pool's equipment room. The value from the pressure transducer 36 is programmed into the AFPCS 10 and becomes the Circulation Pump Set Point (CPSP). The AFPCS 10 continually compares the value received from the pressure transducer 36 to the CPSP and adjusts the output to the circulation pump motor to maintain the value required.

Backwash Speed: during initial start-up the pump speed is adjusted until the desired flow rate is reached. This value is the flow rate that satisfies the filter manufacturer requirements for optimum backwash performance. This value becomes the Backwash Speed (BWSPD). The BWSPD is a pre-set speed that is programmed during final start-up and does not vary during the backwash cycle.

Plus Speed: this speed is an energy saving speed that is either a variable speed that maintains a minimum flow across a pool heater as set forth by the heater manufacturer or a zero output speed (stopped). In cases where a minimum flow rate is to be maintained, during initial start-up the pump speed is adjusted until the desired flow rate is reached. Once the desired flow rate is reached, the speed becomes the Plus Set Point (PSP). Speed change is activated by the time clock 38. The time clock is programmed during start-up to operate at the CPSP for a set number of hours and then switches to the PSP for the remaining hours of a 24-hour period.

For zero output speed, a system-external controller shuts down the heater and provides a signal to the AFPCS 10 when it is safe to shut off the circulation pump 36. When that controller initiates a restart, the AFPCS 10 turns on and begins to control the pump speed in accordance with the pre-selected operating mode.

The six unique operating modes of the AFPCS 10 are shown in FIGS. 6-10 and are defined below:

Bypass: in this mode all internal logic is bypassed and the circulation pump 36 operates at full speed.

Normal Filtration: this is a manual mode in which the pump operates at the CPSP.

Manual Backwash: this is a manual mode in which the pump operates at the BWSPD.

Normal Filtration Plus: this is a semi-manual mode in which the circulation pump 36 operates at either the CPSP or the PSP. The time clock 38 controls how long the AFPCS 10 will run the circulation pump 62 at the CPSP and the PSP. The programming in the time clock switches automatically from one set point to the other.

Automatic: this is a fully automatic mode in which external signals, 120-volts a-c or 24-volts d-c, are received by the AFPCS 10 from the chemical or filter control unit 64.

At a minimum for the automatic mode these signals are comprised of:

(1) a circulation pump activation signal, (2) a backwash pump or valve activation signal, and (3) a pressure transducer signal.

When a signal at the circulation pump 62 is active the AFPCS 10 will run the circulation pump 62 at the CPSP. If the signal is terminated, the pump shuts off. When the signal is active at the backwash pump, the AFPCS 10 will override the CPSP and operate at the backwash speed. When the signal at the backwash pump is dropped, the AFPCS 10 checks for a signal at the circulation pump 62 and if present will operate at the CPSP. If no signal is present the AFPCS 10 will shut off.

Automatic plus: this is a fully automatic mode that uses the same operating sequence as the automatic mode and adding the features of the plus speed.

As long as the signal at the circulation pump 62 is active, the time clock controls how long the AFPCS 10 will run the circulation pump 62 at the CPSP and the PSP. The programming in the time clock will switch from one set point to the other automatically.

At any time during operation, if the backwash signal becomes active the AFPCS 10 will automatically switch into the backwash mode and operate at the BWSPD. When the signal from the backwash pump is terminated, the AFPCS 10 will check for a signal at the circulation pump and, if a signal is present, the AFPCS 10 will operate at the CPSP or the PSP as controlled by the time clock 38.

Figure 6:
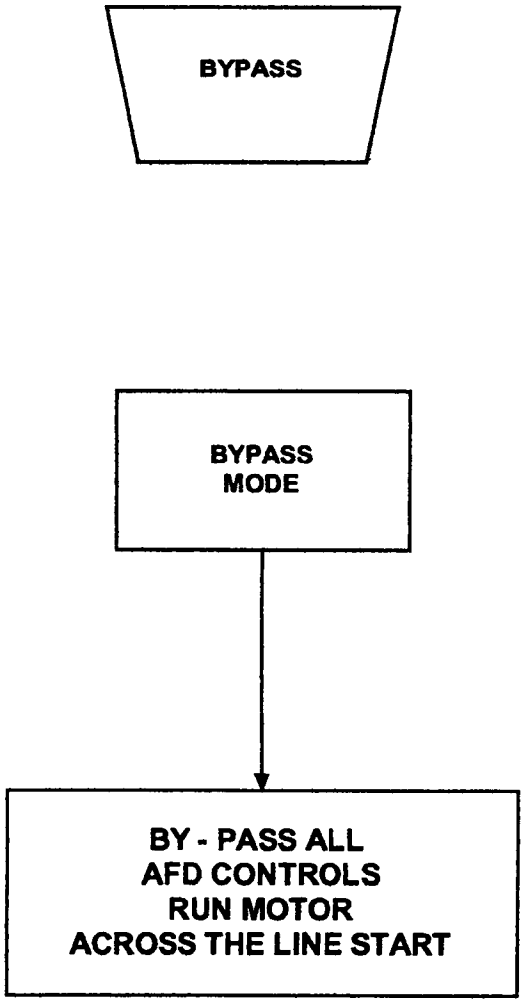
FIG. 6 is a flow diagram of the bypass mode of the software program.

When in the bypass mode, as shown in FIG. 6, all internal logic controls are bypassed and the circulation pump 62 operates at full speed.

Figure 7:
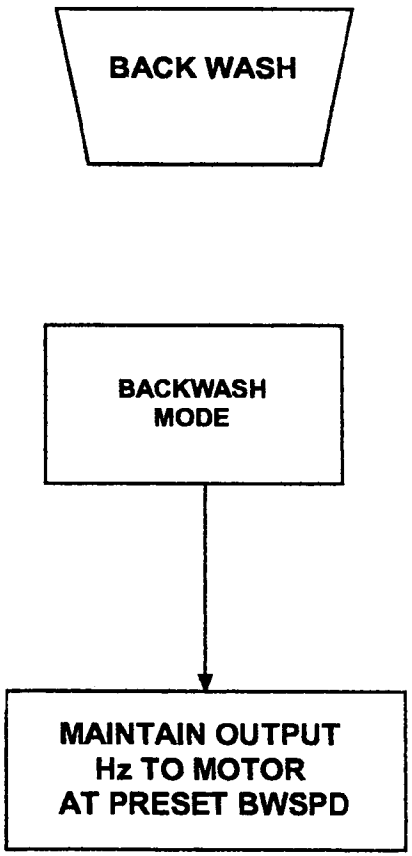
FIG. 7 is a flow diagram of the backwash mode of the software program.

When in the manual backwash mode, as shown in FIG. 7, the AFPCS 10 will run the circulation pump 62 at a pre-programmed BWSPD. The pre-programmed BWSPD is entered during the initial start up and will match the filter manufacturer's recommended flow for optimum backwash.

Figure 8:
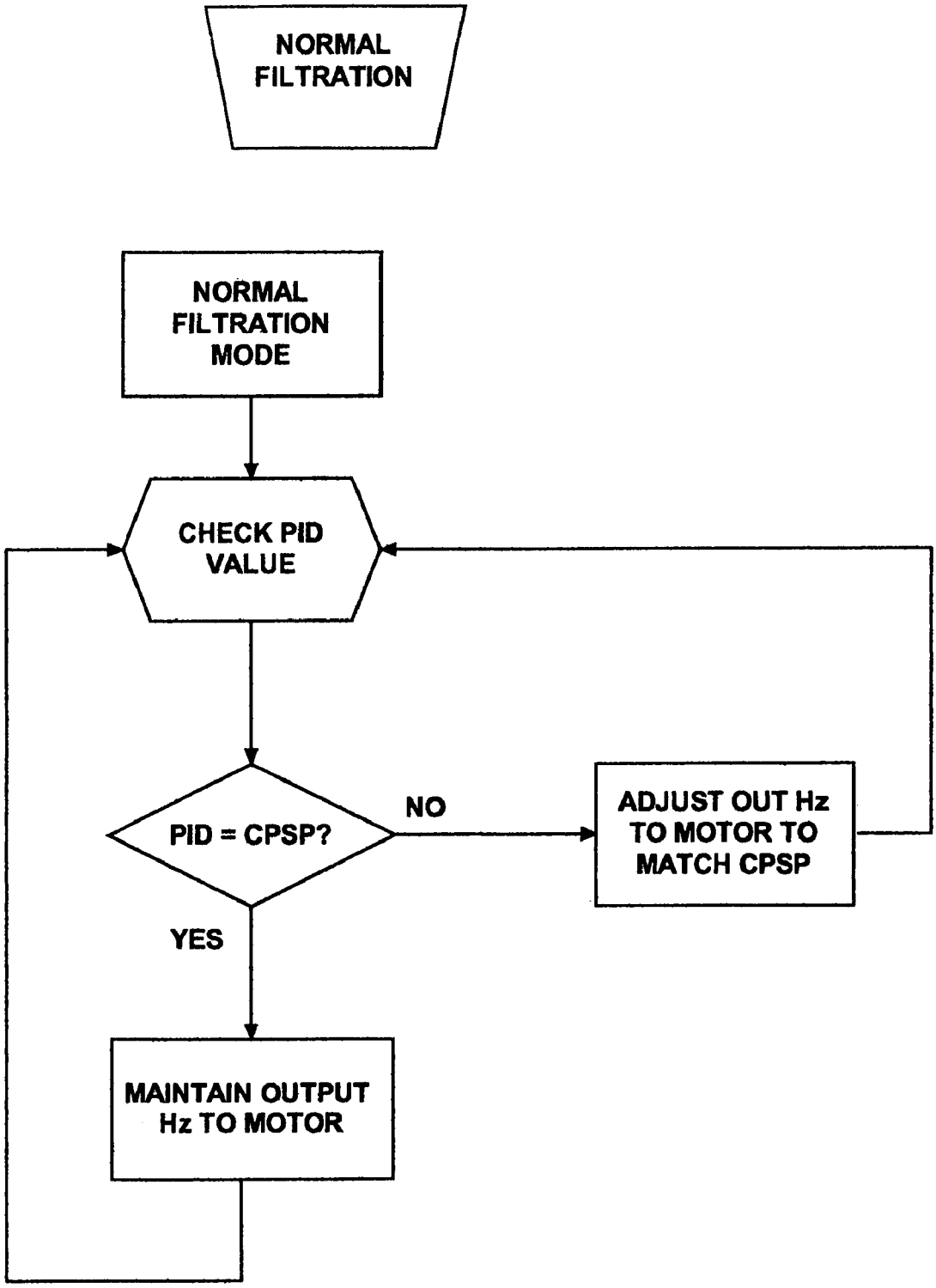
FIG. 8 is a flow diagram of the normal filtration mode of the software program.

When in the normal filtration mode, as shown in FIG. 8, the software 20 searches for an input. The software 20 then compares the input value to the programmed value of CPSP and adjusts the output frequency to the motor to increase or decrease until the values are equal. The AFPCS continually loops through the embedded logic pattern until switched off or the AFPCS is set to a different mode.

Figure 9:
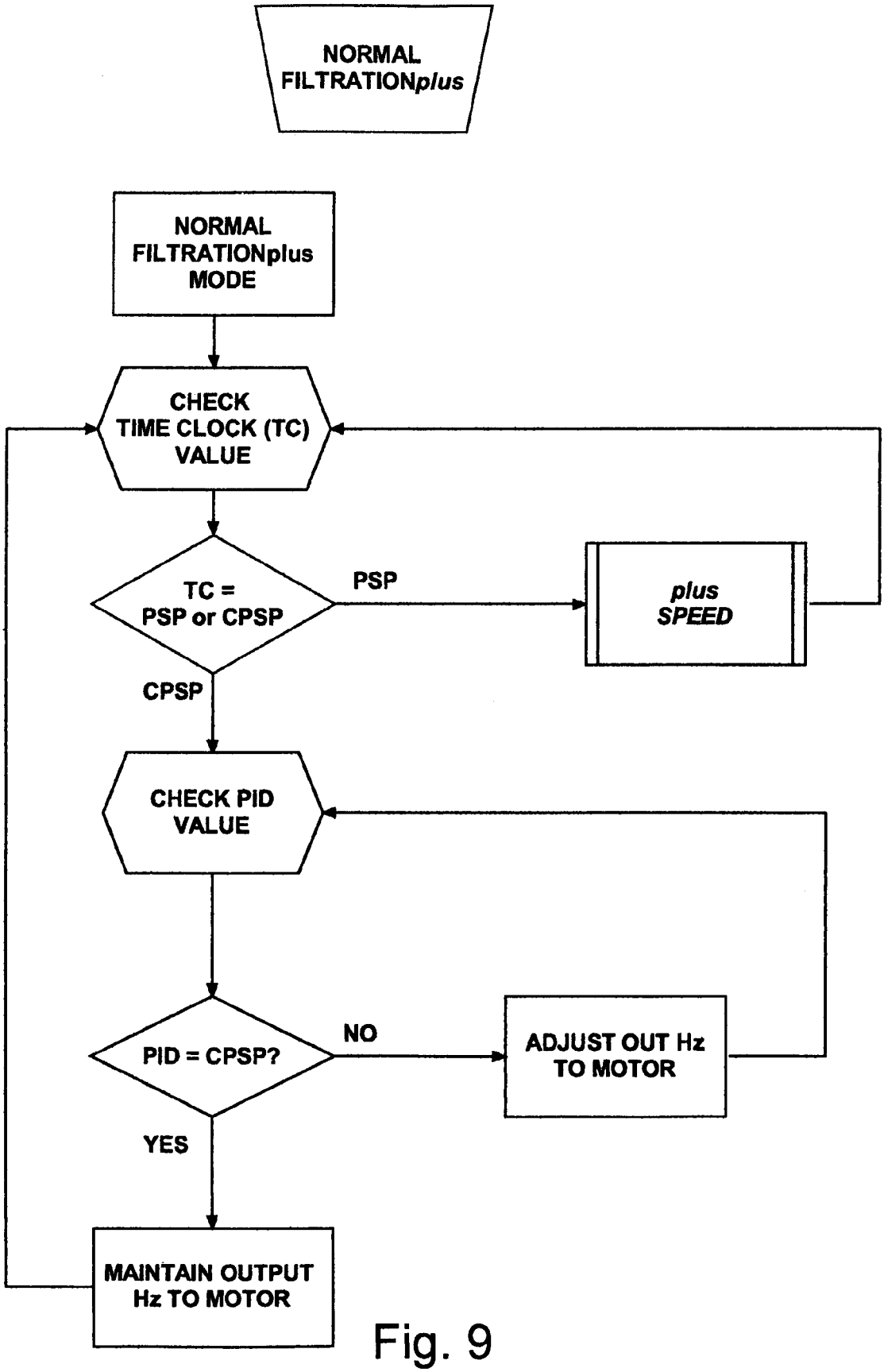
FIG. 9 is a flow diagram of the normal filtration plus mode of the software program.

When in the normal filtration plus mode, as shown in FIG. 9, the AFPCS 10 first looks at the time clock 38 to determine if the plus speed is active or if the normal filtration mode is active. While in this mode the AFPCS 10 will automatically switch between the plus speed and the normal filtration mode based on the output of the time clock.

If the plus speed is active, the software 20 searches for an input. The program then compares the value to the programmed value of the PSP and adjusts the output frequency to the motor of the circulation pump 62 either up or down until the values are equal. The AFPCS 10 will continually loop through this logic pattern until the time clock 38 indicates that the plus speed is no longer active.

Figure 10:
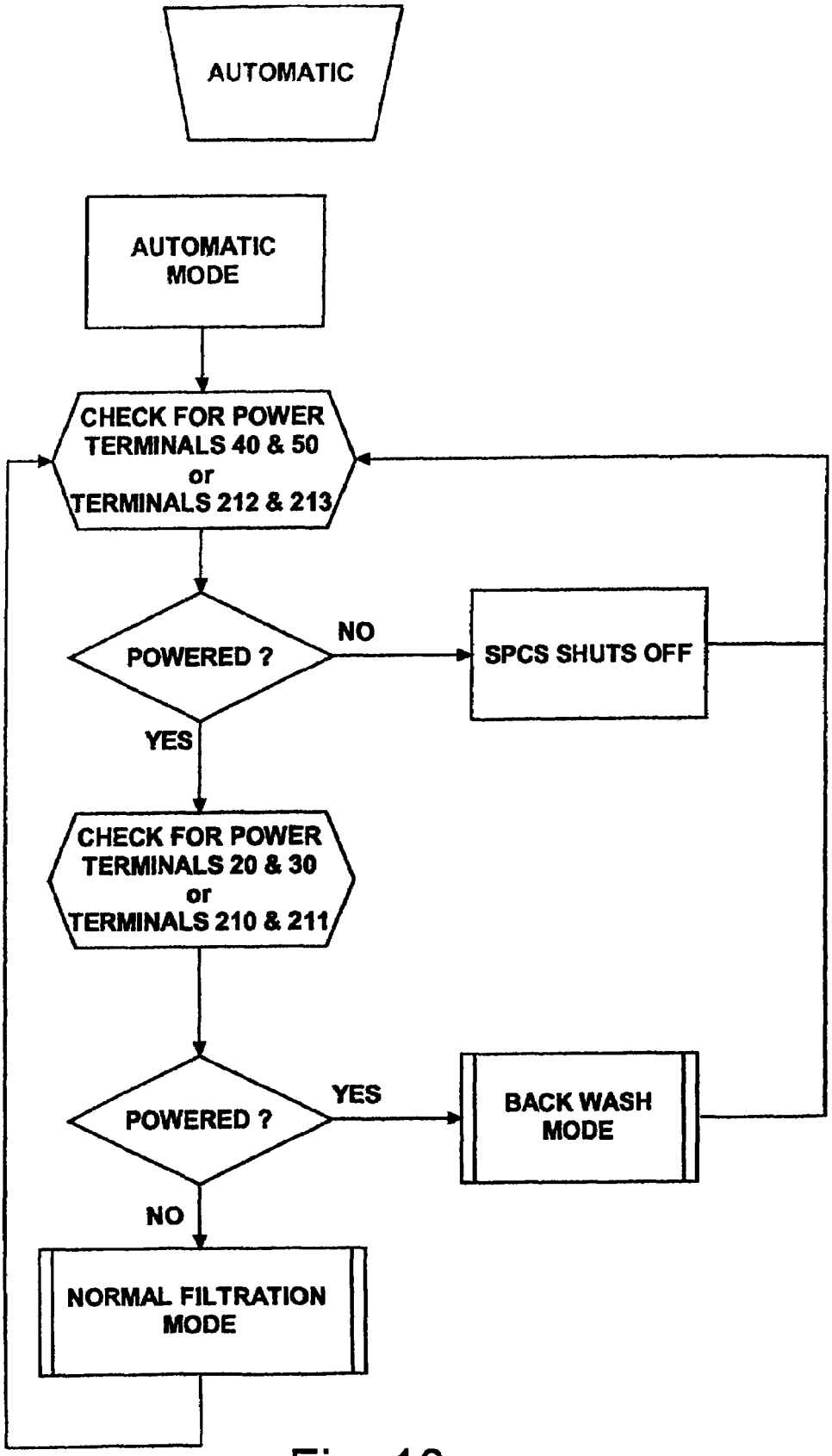
FIG. 10 is a flow diagram of the automatic mode of the software program.

When the AFPCS is in the automatic mode, as shown in FIG. 10, the software program 20 will search for external signals in the following positions:

120 volt power at circulation pump activation, 24 volts power at circulation pump activation, 120 volts power at backwash mode activation, 24 volt power at backwash mode activation.

When a signal at the circulation pump 62 is active the AFPCS 10 will run the circulation pump at the CPSP in the normal filtration mode. If the signal is dropped the pump shuts off. When a signal is active at the backwash, the AFPCS 10 will override the CPSP and operate at the BWSPD. When a signal at the backwash is dropped, the AFPCS will check for a signal at the circulation pump 62 and, if a signal is present, will operate at the CPSP. If no signal is present the AFPCS 10 will shut off. The AFPCS 10 will continually loop through the logic pattern until switched off or placed into a different mode.

Figure 11:
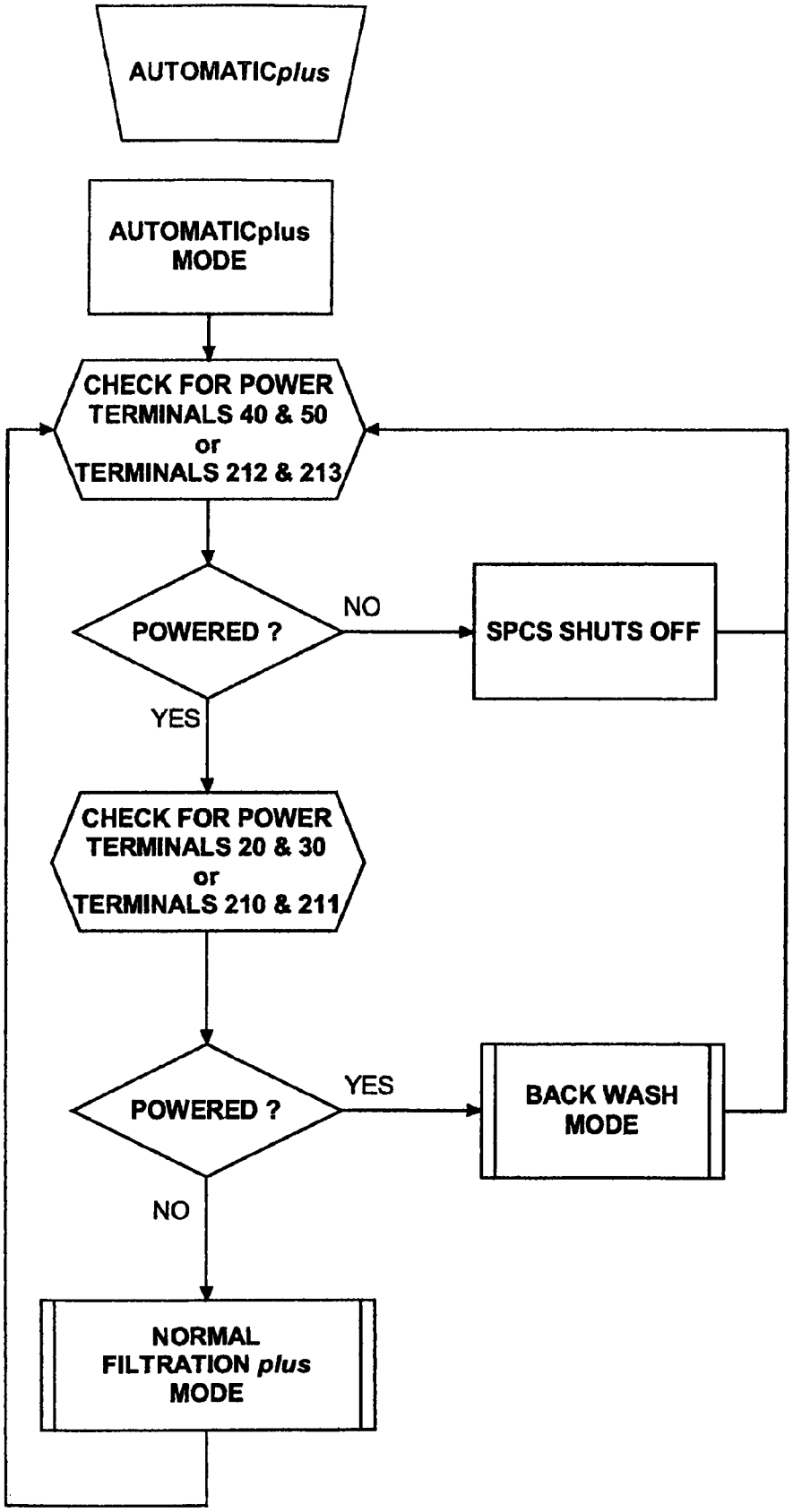
FIG. 11 is a flow diagram of the automatic plus mode of the software program.

When in the automatic plus mode, as shown in FIG. 11, the AFPCS will first check the time clock 38 to determine if the plus speed or the normal filtration mode is active.

If in the normal filtration mode, the software 20 will search for external signals in the following positions:

120 volt power at circulation pump activation, 24 volt power at circulation pump activation, 120 volt power at backwash mode activation, 24 volts power at backwash mode activation.

When a signal at the circulation pump is active the AFPCS 10 will operate the pump at the CPSP in the normal filtration mode. If the signal is dropped, the pump shuts off. When a signal is active at the backwash, the AFPCS will override the CPSP and operate the AFPCS 10 at BWSPD. When the signal at backwash is dropped. the AFPCS 10 will check for a signal at the circulation pump and, if a signal is present, will operate at AFPCS provided that the time clock 38 indicates that normal filtration mode is active. If no signal is present the AFPCS 10 will shut off.

If in plus speed, the software program 20 will search for external signals at the following positions:

120 volt power at circulation pump activation, 24 volt power at circulation pump activation, 120 volt power at backwash mode activation, 24 volt power at backwash mode activation.

When a signal at the circulation pump 62 is active the AFPCS 10 will run the pump at PSP in plus mode. If the signal is dropped the pump shuts off. When a signal is active at backwash, the AFPCS will override the PSP and operate at the BWSPD. When the signal at backwash is dropped, the AFPCS 10 will check for a signal at the circulation pump and, if present, will operate at the PSP provided the time clock 38 indicates that the plus mode is still active. If no signal is present the AFPCS 10 will shut off. The AFPCS 10 will continually loop through this logic pattern until switched off or into a different mode.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and cope of the claims.

The invention claimed is:

1. An adjustable frequency pump control system comprising:

a motor speed control unit producing a motor speed control signal that is applied to a motor that operates a pool's circulation pump, the motor speed control unit being configured to automatically adjust the frequency of the motor speed control signal to a specific frequency that corresponds to a particular design point of a pump's filtration cycle;

an incoming three-phase power input for supplying power to the system;

a power supply having an input connected to the three-phase power input and an output including at least a first voltage and a second voltage;

a signal from a pressure transducer used to measure the pressure within the pool's filtration system, and when enabled by the second voltage, produces a line pressure signal.

a computer readable medium storing one or more sequences of instructions for automatically adjusting the speed of the circulation pump within the pool's filtration system, which instructions, when executed by one or more processors to carry out a process including at least receiving the line pressure signal from the pressure transducer, via the motor speed control;

comparing the line pressure signal with a set point, via the motor speed control; and generating a signal for adjusting the speed of the circulation pump to match the line pressure signal, via the motor speed control.

2. An adjustable frequency pump control system (AFPCS) that functions in combination with a plurality of system-external elements that include a power input, a circulation pump, and a chemical or filter control unit that produces a circulation pump-run signal and a backwash signal, said system comprising:

a) an enclosure that is dimensioned to enclose all elements that comprise said system, said enclosure having means for interfacing with the power input, the circulation pump and the chemical and filter control unit, b) an adjustable frequency drive (AFD) that is programmed during the start-up of said AFPCS with data that includes set points and switching sequences that meet a customer's requirements, said AFD having an input that is connected to the power input and an output consisting of a frequency-controlled, motor speed control signal that sets the speed of the circulation pump by adjusting the frequency of the motor speed control signal, c) a power supply having an input connected to the power input and an output consisting of a first voltage and a second voltage, d) a system mode selector switch having an output that is connected to the first voltage, and an output consisting of a selected mode signal comprising either:

(1) a bypass mode, (2) a normal filtration mode (3) a manual backwash mode, (4) a normal filtration plus mode, (5) an automatic mode, or (6) an automatic plus mode, e) a time clock having an input that is connected to the first voltage, and an output consisting of a mode timing signal, f) a pressure transducer that is enabled when the second voltage is applied, wherein said pressure transducer produces a line pressure signal, g) a program logic control (PLC) having a plurality of inputs and an output, wherein the plurality of inputs are comprised of:

(1) the selected mode signal that is applied from said system mode selector switch, (2) a mode timing signal that is applied from said time clock, (3) the circulation pump-run signal applied from the chemical or filter control unit (64), (4) the backwash signal applied from the chemical or filter control unit, and (5) the line pressure signal applied from said pressure transducer, wherein the output of said PLC is the frequency-set signal that is applied to said AFD, which in combination with a software program, produces the frequency controlled motor speed signal that is ultimately utilized to control the speed of the circulation pump.

3. The system as specified in claim 2 wherein said enclosure is comprised of a National Electrical Manufacturers Association (NEMA) wall-mounted enclosure having:

a) a front door that includes a neoprene perimeter gasket that prevents inclement weather and corrosive environments from entering said enclosure, and b) an internal panel that includes an accessible circuit breaker activation handle, a keypad, and a mode selector switch control knob.

4. The system as specified in claim 3 wherein said power input is comprised of an a-c power input that is selected from:

a) 200 to 300 volts a-c, or b) 380 to 420 volts a-c, wherein said a-c voltages operate at a frequency between 50 to 60 Hz.

5. The system as specified in claim 4 further comprising a circuit breaker and line reactor filter, wherein said circuit breaker has an input that is connected to the power input and an output that passes through the line reactor filter prior to being applied to said AFD, wherein said line reactor filter is designed to filter power line:

a) disturbances b) harmonics c) surge currents, and d) spikes.

6. The system as specified in claim 5 further comprising an AFD motor contactor having an input that is applied to the frequency-controlled, motor speed control signal, and an output that passes the signals through a motor thermal overload prior to being applied to the motor driving the circulation pump, wherein the speed of the pump motor is governed by the frequency of the frequency-controlled, motor speed control signal.

7. The system as specified in claim 6 wherein the motor speed control signal is comprised of:

a) normal filtration speed, b) backwash speed, and c) plus speed.

8. The system as specified in claim 3 wherein the front door is opened when a password is entered into the keypad located on the front panel of said enclosure.

9. An adjustable frequency pump control system (AFPCS) that functions in combination with a plurality of system-external elements that include a three-phase power input, a circulation pump, and a chemical or filter control unit that produces a circulation pump-run signal and a backwash signal, said system comprising:

a) and enclosure that is dimensioned to enclose all the elements that comprise said system, and having a means for interfacing with the three-phase power input, the circulation pump and the chemical or filter control unit, b) a set of three circuit breakers each having an input that is connected respectively to the three lead lines from the three-phase power input, wherein the output of said circuit breakers is comprised of three output power leads, c) a set of three line reactor filters, each having an input that is connected respectively to the three output lead lines from the outputs of said three circuit breakers, wherein the output of each said line reactor filter is a filtered a-c voltage, d) an adjustable frequency drive (AFD) that operates in combination with software that is accessible via a keypad, said AFD having an input that is applied to the filtered a-c voltages from said line reactor filters, and a frequency-set signal wherein said AFD has a memory that is programmed during the start-up of said AFPCS with data that includes set points and switching sequences that meet a customer's requirements, wherein the output of said AFD is a motor contactor close signal, and a set of three frequency-controlled motor speed signals that set the speed of the circulation pump by controlling the frequency of the signals, wherein three motor speeds are available:

(1) normal filtration speed, (2) backwash speed, and (3) plus speed e) an AFD motor contactor that, when closed by the application of the motor contactor close signal, passes the motor speed control signals from said AFD, f) a bypass contactor having an input that is connected to the three output power leads from said three circuit breakers, and an output that is connected in parallel across the output of said AFD motor contactor, g) a motor thermal overload having an input connected to the outputs of said AFD motor contactor and said bypass contactor, wherein the output of said motor thermal overload is the set of motor speed control signals that in combination with said AFD produces a selected frequency-set signal that controls the speed of the circulation pump, h) a power transformer having a primary winding and a secondary winding, wherein the primary winding is connected across the output power leads applied from the output of said circuit breakers, wherein the secondary winding produces a stepped-down voltage, i) a system mode selector switch having an input that is connected across the secondary winding of said power transformer, and an output consisting of a selected mode signal comprising either:

(1) a bypass mode, (2) a normal filtration mode, (3) a manual backwash mode, (4) a normal filtration plus mode, (5) an automatic mode, and (6) an automatic plus mode, j) a d-c power supply having an input that is connected across the secondary winding of said power transformer, and an output consisting of 24-volts d-c, k) a time clock having an input that is connected across the secondary winding of said power transformer, and an output consisting of a mode timing signal, l) a fan having an input that is connected across the secondary winding of said control transformer wherein said cooling fan is positioned on said enclosure to provide optimum cooling airflow through said enclosure, m) a pressure transducer that is enabled when the 24-volts d-c from said d-c power supply is applied, wherein said pressure transducer produces a line pressure signal, n) a program logic control (PLC) having six inputs and an output, wherein the six inputs are comprised of:

(1) the stepped-down voltage applied from the secondary winding of said power transformer, (2) the select mode signal that is applied from said system mode selector switch (32)

(3) a mode timing signal that is applied from the time clock, (4) the circulation pump-run signal that is applied form the chemical or filter control unit, (5) the backwash signal that is applied from the automatic chemical and filter control, and (6) the line pressure signal that is applied from said pressure transducer, wherein the output of said PLC is the frequency-set signal that is applied to said AFD, which in combination with said software, produces the frequency-set signal that is ultimately utilized to control the speed of the circulation pump.

10. The system as specified in claim 9 wherein said enclosure is comprised of a National Electrical Manufacturers Association (NEMA) wall-mounted enclosure having a front door that includes a neoprene perimeter gasket that prevents inclement weather and corrosive environments from entering said enclosure.

11. The system as specified in claim 10 wherein said NEMA enclosure further comprises an internal panel that includes an accessible circuit breaker activation handle, the keypad and a mode selector switch control knob.

12. The system as specified in claim 9 wherein said three-phase a-c power input is selected from:

a) 200 to 230 volts a-c, or b) 380 to 420-volts a-c, wherein said a-c voltages operate at a frequency between 50 to 60 Hz.

13. The system as specified in claim 9 wherein each said line reactor filter is designed to filter:

a) power line disturbances, b) harmonics, c) surge currents, and d) power line spikes.

14. The system as specified in claim 9 wherein said software controls the settings that are retained in the memory of said AFD, wherein the settings comprise:

a) motor horsepower, b) motor RPM, c) current drawn, d) circulation pump set point (CPSP), e) backwash speed (BWSPD), and f) plus set point (PSP).

15. The system as specified in claim 9 wherein said keypad has a display that comprises:

a) circulation pump speed, b) pump frequency, c) accumulated power usage, d) current power usage, e) pool's return line pressure,
f) accumulated run time, and
g) fault messages.

16. The system as specified in claim 9 wherein said time clock is comprised of an alpha-numeric display.

17. The system as specified in claim 9 wherein said fan further comprises an air filter positioned at the output of said fan.

18. The system as specified in claim 9 further comprising a password that is entered into said keypad before the enclosure door can be opened.

19. The system as specified in claim 9 wherein said software is comprised of the following major system mode routines:
a) bypass mode,
b) backwash mode,
c) normal filtration mode,
d) normal filtration plus mode, and
e) automatic plus mode.

20. An adjustable frequency pump control system (AFPCS) that functions in combination with a plurality of system-external elements that include a power input, a circulation pump, and a chemical or filter control unit that produces a circulation pump-run signal and a backwash signal, said system comprising:
a) an enclosure that is dimensioned to enclose all elements that comprise said system, wherein said enclosure has the ability to interface with the power input, the circulation pump and the chemical and filter control unit,
b) an adjustable frequency drive (AFD) that is programmed during the start-up of said AFPCS with data that includes set points and switching sequences that meet a customer's requirements, said AFD having an input that is connected to the power input and an output consisting of a frequency-controlled, motor speed control signal that sets the speed of the circulation pump by adjusting the frequency of the motor speed control signal,
c) a power supply having an input connected to the power input and an output consisting of a first voltage and a second voltage,
d) a system mode selector switch having an output that is connected to the first voltage, and an output consisting of a selected mode signal comprising either:
(1) a bypass mode,
(2) a normal filtration mode
(3) a manual backwash mode,
(4) a normal filtration plus mode,
(5) an automatic mode, or
(6) an automatic plus mode,
e) a time clock having an input that is connected to the first voltage, and an output consisting of a mode timing signal,
f) a pressure transducer that is enabled when the second voltage is applied, wherein said pressure transducer produces a line pressure signal,
g) a program logic control (PLC) having a plurality of inputs and an output, wherein the plurality of inputs are comprised of:
(1) the selected mode signal that is applied from said system mode selector switch,
(2) a mode timing signal that is applied from said time clock,
(3) the circulation pump-run signal applied from the chemical or filter control unit,
(4) the backwash signal applied from the chemical or filter control unit, and
(5) the line pressure signal applied from said pressure transducer, wherein the output of said PLC is the frequency-set signal that is applied to said AFD, which in combination with a software program, produces the frequency controlled motor speed signal that is ultimately utilized to control the speed of the circulation pump.

21. The system as specified in claim 20 wherein said enclosure is comprised of a National Electrical Manufacturers Association (NEMA) wall-mounted enclosure having:
a) a front door that includes a neoprene perimeter gasket that prevents inclement weather and corrosive environments from entering said enclosure, and
b) an internal panel that includes an accessible circuit breaker activation handle, a keypad, and a mode selector switch control knob.

22. The system as specified in claim 20 wherein said power input is comprised of an a-c power input that is selected from:
a) 200 to 300 volts a-c, or
b) 380 to 420-volts a-c, wherein said a-c voltages operate at a frequency between 50 to 60 Hz.

23. The system as specified in claim 20 further comprising a circuit breaker and line reactor filter, wherein said circuit breaker has an input that is connected to the power input and an output that passes through the line reactor filter prior to being applied to said AFD, wherein said line reactor filter is designed to filter power line:
a) disturbances
b) harmonics
c) surge currents, and
d) spikes.

24. The system as specified in claim 20 further comprising an AFD motor contactor having an input that is applied to the frequency-controlled, motor speed control signal, and an output that passes the signals through a motor thermal overload prior to being applied to the motor driving the circulation pump, wherein the speed of the pump motor is governed by the frequency of the frequency-controlled, motor speed control signal.

25. The system as specified in claim 20 wherein the motor speed control signal is comprised of:
a) normal filtration speed,
b) backwash speed, and
c) plus speed.

26. The system as specified in claim 21 wherein the front door is opened when a password is entered into the keypad located on the front panel of said enclosure.

27. An adjustable frequency pump control system (AFPCS) that functions in combination with a plurality of system-external elements that include a three-phase power input, a circulation pump, and a chemical or filter control unit that produces a circulation pump-run signal and a backwash signal, said system comprising:
a) an enclosure that is dimensioned to enclose all the elements that comprise said system, wherein said enclosure has the ability to interface with the three-phase power input, the circulation pump and the chemical or filter control unit,
b) a set of three circuit breakers each having an input that is connected respectively to the three lead lines from the three-phase power input, wherein the output of said circuit breakers is comprised of three output power leads,
c) a set of three line reactor filters, each having an input that is connected respectively to the three output lead lines from the outputs of said three circuit breakers, wherein the output of each said line reactor filter is a filtered a-c voltage, d) an adjustable frequency drive (AFD) that operates in combination with software that is accessible via a keypad, said AFD having an input that is applied to the filtered a-c voltages from said line reactor filters, and a frequency-set signal wherein said AFD has a memory that is programmed during the start-up of said AFPCS with data that includes set points and switching sequences that meet a customer's requirements wherein the output of said AFD is a motor contactor close signal, and a set of three frequency-controlled motor speed signals that set the speed of the circulation pump by controlling the frequency of the signals, wherein three motor speeds are available:
(1) normal filtration speed,
(2) backwash speed, and
(3) plus speed e) an AFD motor contactor that, when closed by the application of the motor contactor close signal, passes the motor speed control signals from said AFD, f) a bypass contactor having an input that is connected to the three output power leads from said three circuit breakers, and an output that is connected in parallel across the output of said AFD motor contactor, g) a motor thermal overload having an input connected to the outputs of said AFD motor contactor and said bypass contactor, wherein the output of said motor thermal overload is the set of motor speed control signals that in combination with said AFD produces a selected frequency-set signal that controls the speed of the circulation pump, h) a power transformer having a primary winding and a secondary winding, wherein the primary winding is connected across the output power leads applied from the output of said circuit breakers, wherein the secondary winding produces a stepped-down voltage, i) a system mode selector switch having an input that is connected across the secondary winding of said power transformer, and an output consisting of a selected mode signal comprising either:
(1) a bypass mode,
(2) a normal filtration mode,
(3) a manual backwash mode,
(4) a normal filtration plus mode,
(5) an automatic mode, and
(6) an automatic plus mode, j) a d-c power supply having an input that is connected across the secondary winding of said power transformer, and an output consisting of 24-volts d-c, k) a time clock having an input that is connected across the secondary winding of said power transformer, and an output consisting of a mode timing signal, l) a fan having an input that is connected across the secondary winding of said control transformer wherein said cooling fan is positioned on said enclosure to provide optimum cooling airflow through said enclosure, m) a pressure transducer that is enabled when the 24-volts d-c from said d-c power supply is applied, wherein said pressure transducer produces a line pressure signal, n) a program logic control (PLC) having six inputs and an output, wherein the six inputs are comprised of:
(1) the stepped-down voltage applied from the secondary winding of said power transformer,
(2) the select mode signal that is applied from said system mode selector switch,
(3) a mode timing signal that is applied from the time clock,
(4) the circulation pump-run signal that is applied from the chemical or filter control unit,
(5) the backwash signal that is applied from the automatic chemical and filter control, and
(6) the line pressure signal that is applied from said pressure transducer, wherein the output of said PLC is the frequency-set signal that is applied to said AFD, which in combination with said software, produces the frequency-set signal that is ultimately utilized to control the speed of the circulation pump.

28. The system as specified in claim 27 wherein said enclosure is comprised of a National Electrical Manufacturers Association (NEMA) wall-mounted enclosure having a front door that includes a neoprene perimeter gasket that prevents inclement weather and corrosive environments from entering said enclosure.

29. The system as specified in claim 28 wherein said NEMA enclosure further comprises an internal panel that includes an accessible circuit breaker activation handle, the keypad and a mode selector switch control knob.

30. The system as specified in claim 27 wherein said three-phase a-c power input is selected from:
a) 200 to 230 volts a-c, or
b) 380 to 420-volts a-c, wherein said a-c voltages operate at a frequency between 50 to 60 Hz.

31. The system as specified in claim 27 wherein each said line reactor filter is designed to filter:
a) power line disturbances,
b) harmonics,
c) surge currents, and
d) power line spikes.

32. The system as specified in claim 27 wherein said software controls the settings that are retained in the memory of said AFD, wherein the settings comprise:
a) motor horsepower,
b) motor RPM,
c) current drawn,
d) circulation pump set point (CPSP),
e) backwash speed (BWSPD), and
f) plus set point (PSP).

33. The system as specified in claim 27 wherein said keypad has a display that comprises:
a) circulation pump speed,
b) pump frequency,
c) accumulated power usage,
d) current power usage,
e) pool's return line pressure,
f) accumulated run time, and
g) fault messages.

34. The system as specified in claim 27 wherein said time clock is comprised of an alpha-numeric display.

35. The system as specified in claim 27 wherein said fan further comprises an air filter positioned at the output of said fan.

36. The system as specified in claim 27 further comprising a password that is entered into said keypad before the enclosure door can be opened.

37. The system as specified in claim 27 wherein said software is comprised of the following major system mode routines:
a) bypass mode,
b) backwash mode,
c) normal filtration mode,
d) normal filtration plus mode, and
e) automatic plus mode.

38. A method for automatically adjusting the speed of a circulation pump within a pool's filtration system, comprising:

a) interfacing with a power input, a circulation pump and a chemical or filter control unit via an enclosure, b) programming an adjustable frequency drive (AFD) during the start-up of an adjustable frequency pump control system (AFPCS) with data that includes set points and switching sequences that meet a customer's requirements, said AFD having an input that is connected to the power input and an output consisting of a frequency-controlled, motor speed control signal that sets the speed of the circulation pump by adjusting the frequency of the motor speed control signal, c) sending power to a power supply having an input connected to the power input and an output consisting of a first voltage and a second voltage, d) sending a selected mode signal to a programmed logic control, via a system mode selector switch having an output that is connected to the first voltage, wherein the selected mode signal comprises either:

(1) a bypass mode, (2) a normal filtration mode, (3) a manual backwash mode, (4) a normal filtration plus mode, (5) an automatic mode, or (6) an automatic plus mode, e) sending a mode timing signal to the programmed logic control, via a time clock having an input that is connected to the first voltage, f) sending a line pressure signal to the programmed logic control, via a pressure transducer that is enable when the second voltage is applied, g) sending a circulation pump-run signal to the programmed logic control via the chemical or filter control unit, h) sending a backwash signal to the programmed logic control via the chemical or filter control unit i) sending a frequency-set signal from the programmed logic control to the AFD, which in combination with a software program, produces the frequency controlled motor speed signal that is ultimately utilized to control the speed of the circulation pump.

39. The method of claim 38 wherein said enclosure is comprised of a National Electrical Manufacturers Association (NEMA) wall-mounted enclosure having:

a) a front door that includes a neoprene perimeter gasket that prevents inclement weather and corrosive elements from entering said enclosure, and b) an internal panel that includes an accessible circuit breaker activation handle, a keypad, and a mode selector switch control knob.

40. The method of claim 38 wherein said power input is comprised of an a-c power input that is selected from:

a) 200 to 300 volts a-c, or b) 380 to 420-volts a-c, wherein said a-c voltages operate at a frequency between 50 to 60 Hz.

41. The method of claim 38 further comprising a circuit breaker and line reactor filter, wherein said circuit breaker has an input that is connected to the power input and an output that passes through the line reactor filter prior to being applied to said AFD, wherein said line reactor filter is designed to filter power line:

a) disturbances b) harmonics c) surge currents, and d) spikes.

42. The method of claim 38 further comprising an AFD motor contactor having an input that is applied to the frequency-controlled, motor speed control signal, and an output that passes the signals through a motor thermal overload prior to being applied to the motor driving the circulation pump, wherein the speed of the pump motor is governed by the frequency of the frequency-controlled, motor speed control signal.

43. The method of claim 38 wherein the motor speed control signal is comprised of:

a) normal filtration speed, b) backwash speed, and c) plus speed.

44. The method of claim 39 wherein when the front door is opened, a password may be entered into the keypad located on the front panel of said enclosure.

* * * * *